United States Patent [19]

Lai

[11] Patent Number: 4,966,180

[45] Date of Patent: Oct. 30, 1990

[54] EXPANSIBLE TYPE TRIANGULAR UMBRELLA RIBS AND THE RELATED COLLAPSING MECHANISM

[76] Inventor: Chenmin Lai, 2, Alley 2, Lane 102, Dong Hwa St., Taipei, Taiwan

[21] Appl. No.: 255,464

[22] Filed: Oct. 11, 1988

[51] Int. Cl.[5] ..... A45B 19/00

[52] U.S. Cl. ..... 135/25 R; 135/26; 135/29

[58] Field of Search ..... 135/25 R, 20 R, 26, 135/29

[56] References Cited

U.S. PATENT DOCUMENTS

| | | | |
|---|---|---|---|
| 3,457,931 | 7/1969 | Shimizu | 135/25 R |
| 3,853,135 | 12/1974 | Schafer | 135/25 R |
| 4,077,420 | 3/1978 | Schultes et al. | 135/25 R |
| 4,420,007 | 12/1983 | Wu | 135/25 R |
| 4,766,917 | 8/1988 | Yang | 135/25 R |

*Primary Examiner*—David A. Scherbel
*Assistant Examiner*—Lan Mai
*Attorney, Agent, or Firm*—Morton J. Rosenberg; David I. Klein

[57] ABSTRACT

Expansible type triangular umbrella ribs and the related collapsing mechanism, wherein the expansible first main rib is arranged to penetrate through the second main rib which is connected with the linking rib, the rear end of the first main rib being directly connected with the front end of the first support rib by pivotal joint, the rear end of the linking rib being pivotally connected to the first support rib, such that the first main rib is expansible to slip along the pivotal connecton between the second main rib and the linking rib; the first main rib, the linking rib and the first support rib being to form a triangular rib structure, the front U-channel of the first support rib being to provide an prolonged flange for receiving the rear portion of the linking rib; the first main rib, the linking rib and the first support rib being arranged in a straight line at the time the umbrella being fully opened; at the time the pivotal connection of the first main rib and the first support rib being attached to the linking rib on a slant, no gap being left between the first main rib, the first support rib and the linking rib, and the torsional force being minimized and the stability of the rib strcuture being improved; by means of the arrangement of the protruding circular tail at the send step of the central shaft to stop the gap between the lower nest plate and the first step of the central shaft at the time the umbrella being opened, the lower nest plate being stabilized to prevent the umbrella rib strcuture from sudden collapsing.

4 Claims, 15 Drawing Sheets

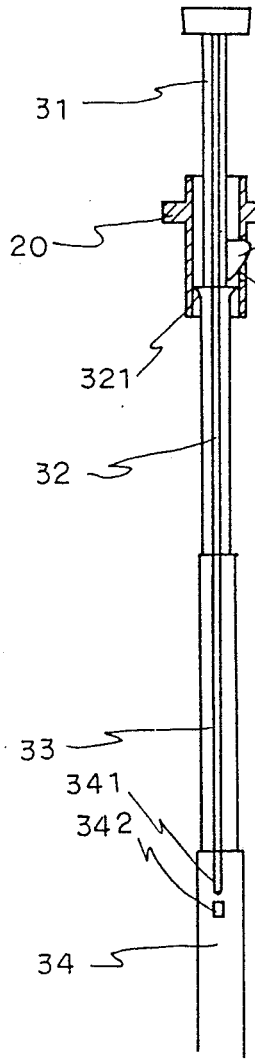
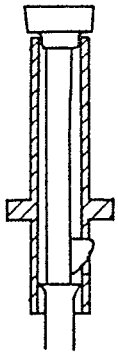
FIG. 10
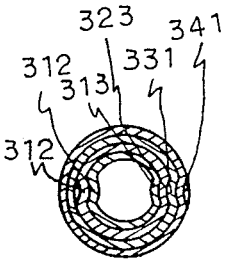
FIG. 10A
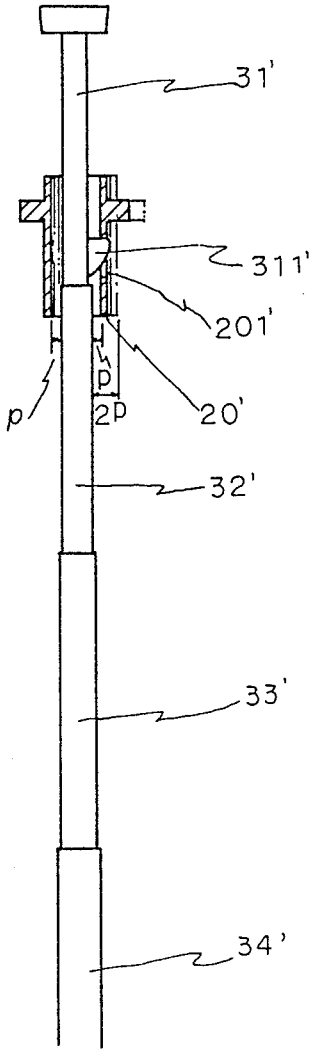
FIG 9
FIG 8

EXPANSIBLE TYPE TRIANGULAR UMBRELLA RIBS AND THE RELATED COLLAPSING MECHANISM

BACKGROUND OF THE INVENTION

The present invention is related to an expansible type triangular umbrella ribs and the related collapsing mechanism, by means of an expansible first main rib to penetrate through the pivotal connection of a second main rib and a linking rib to freely slide therealong, and to let the first main rib, the linking rib and a first support rib form a triangular linking-up umbrella rib structure; by means of the protruding circular tail arranged at the top end of the second step of the central shaft to stabilize the lower nest and to prevent the lower nest from breaking away when the umbrella is opened.

Regular foldable umbrella rib structure is as shown in FIG. 1, wherein the ribs (1') (2') (3') (4') are pivotally connected one another to form a configuration similar to parallelogram ABCD. When the umbrella is opened, AD, BC, CD are not in a straight line, and a space D is left between AD and BC. When an outer force is applied upon the umbrella rib structure, a torsional force will rise through space D, to interfere with or damage all pivotal connecting points to further loosen the rib structure and shorten the service life of the umbrella.

The central shaft of regular multi-fold type umbrella (as shown in FIG. 8) is a multi-stepped type. The upper step has bigger caliber and the lower step has smaller caliber. The more the number of the steps is provided, the bigger the difference of the caliber will be. When the umbrella is opened, the lower nest plate (20') is moved to the top dead point to let the stopper (311') be retained in the locating hole (201') of the lower nest plate (20'). In this arrangement, the inner diameter of the lower nest plate (20') is bigger than the central shaft (34'), and there is a distance P left between the lower nest plate (20') and the central shaft (31') when the lower nest plate (20') is moved to the top dead point. Therefore, the lower nest plate (20') tends to vibrate. If the lower nest plate (20') is inclined to the lateral side where the stopper located, the distance P will be doubled, and the lower nest plate (20') may break away from the constraint of the stopper to let the umbrella be collapsed.

In view of said problems, the present invention is thus created to be intended for elimination of the above-described drawbacks.

SUMMARY OF THE INVENTION

The main object of the present invention is to provide a triangular linking-up umbrella rib structure comprised of a first main rib, a linking rib, and a first support rib, wherein the first main rib is connected with the linking rib by flexible way through pivotal joint to let the first main rib be sliding therethrough, and the first main rib is arranged to provide a prolonged flange for receiving the connection portion with the linking rib. When the umbrella is opened, by means of linking-up effect, the first main rib, the linking rib, and the first support rib are arranged in a stable straight line to eliminate torsional force so as to make the structure practical, stable and durable in use.

Another object of the present invention is to provide an expansible main rib to match with the above-described triangular linking-up umbrella rib structure to provide a four-fold rib structure.

Another object of the present invention is to provide an improved pivotal connection structure, to let the first main rib and the first support rib be connected through circular surface ends to prevent the umbrella cloth from been jammed by the rib B and the protruding portion A when the umbrella is opened and the rib B is set in the rib C (as illustrated in FIG. 6-1 ).

A yet further object of the present invention is to provide a multi-stepped central shaft wherein the second step of the shaft is arranged to provide a protruding circular tail at the top, to stop the gap between the lower nest plate and the central shaft, so as to let the lower nest plate be stabilized when the umbrella is opened, and to prevent the lower nest plate from breaking away of the constraint of the stopper.

BRIEF DESCRIPTION OF THE DRAWINGS

FIG. 2A-1 is an enlarged sectional view of the joint indicated in FIG. 2A-2;

FIG. 2A-2 is a partial elevation view of the umbrella structure;

FIG. 2B-1 is an enlarged sectional view of the support rib joint shown in a non-fully opened position;

FIG. 2B-2 is an enlarged sectional view of the support rib joint shown in a fully opened position;

FIG. 6-1 is a partial perspective view of a front end portion of a support rib;

FIG. 8 is a sectional view of a lower nest plate of the prior art;

FIG. 9 is a sectional view of the lower nest plate of the present invention;

FIG. 10 is a sectional view of another embodiment of the lower nest plate of the present invention;

FIG. 10A is a cross-sectional view of the umbrella shaft illustrating the concentric arrangement of the telescoping sections;

FIG. 11B-1 illustrates an alternate embodiment of the automatic umbrella structure of FIG. 11A;

DESCRIPTION OF THE PREFERRED EMBODIMENTS

Figure 1:
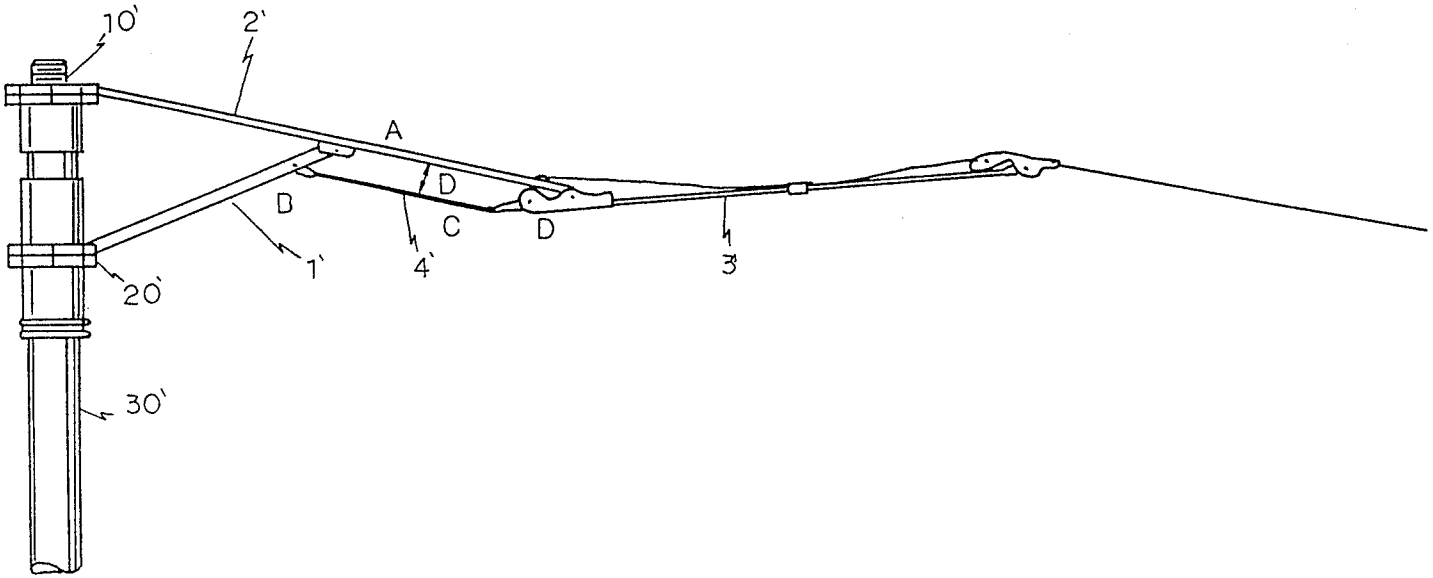
FIG. 1 is a schematic plain drawing of the prior art, illustrating the structure of the umbrella ribs when the umbrella is opened.
Figure 2A:
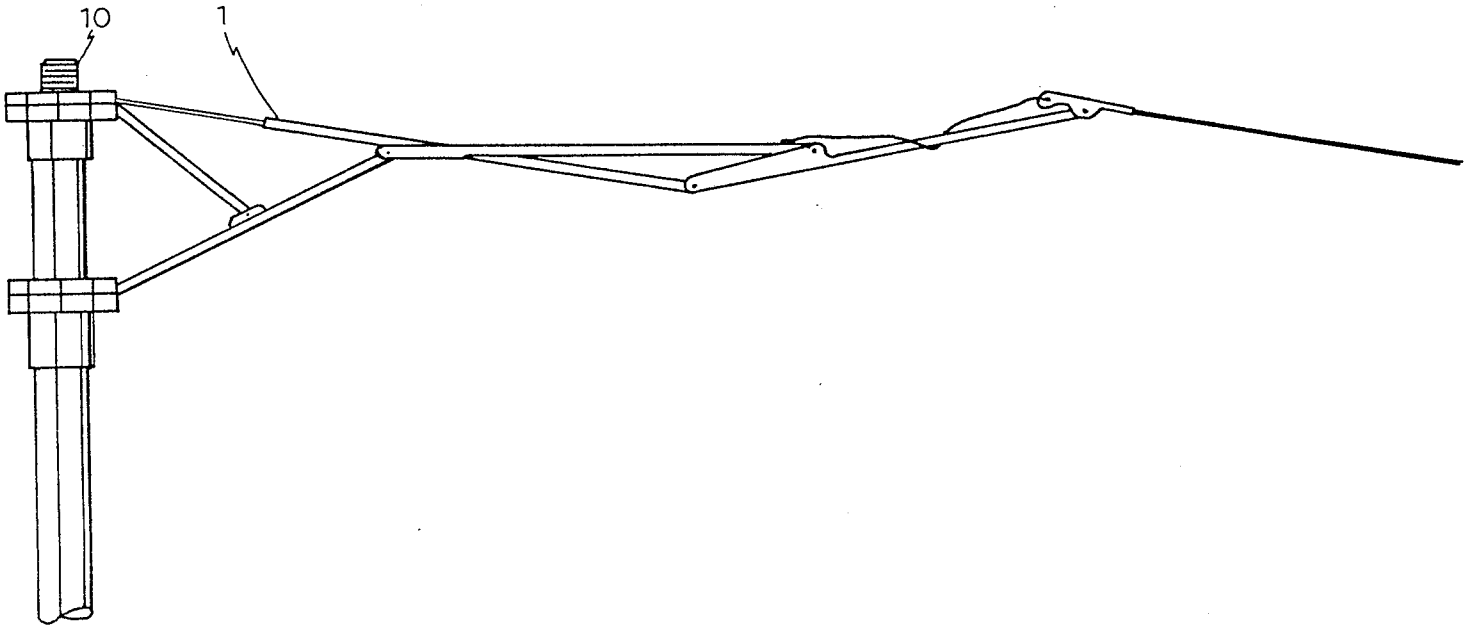
FIG. 2A is a schematic drawing of the present invention, wherein the umbrella is opened.
Figures 2, 2A:
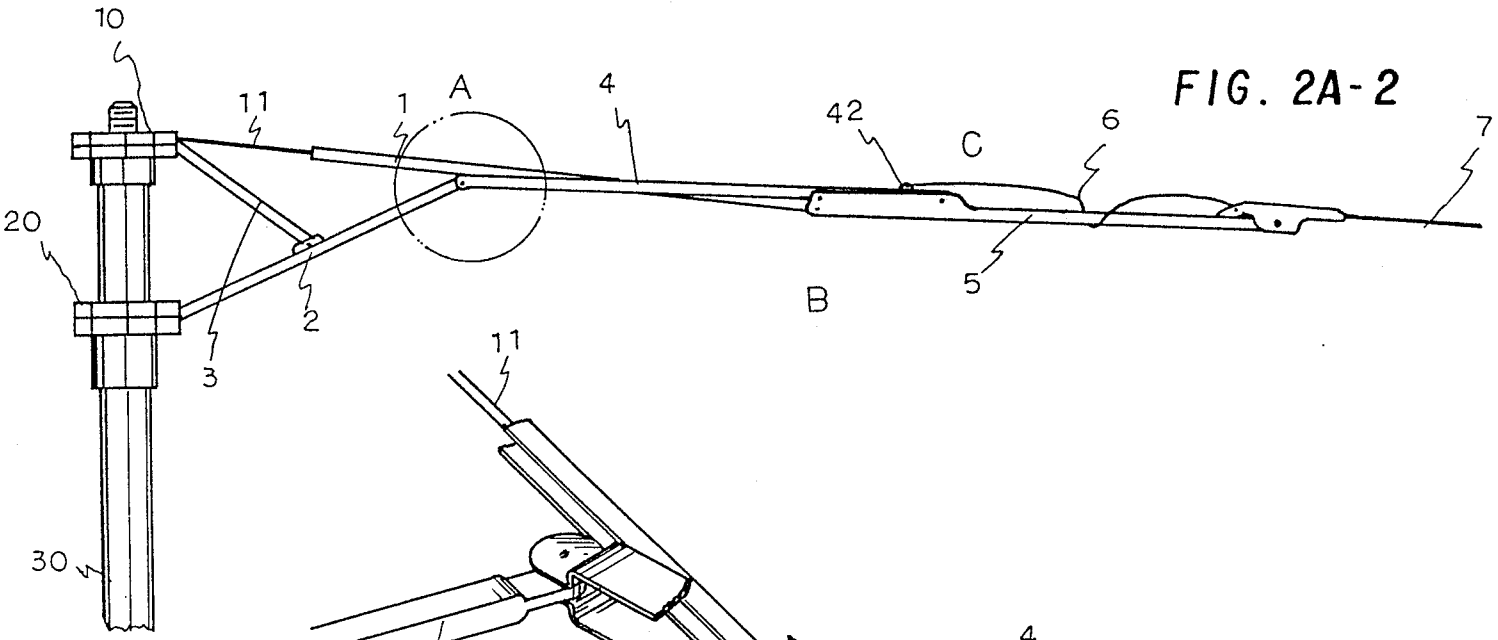
Figures 1, 2A:
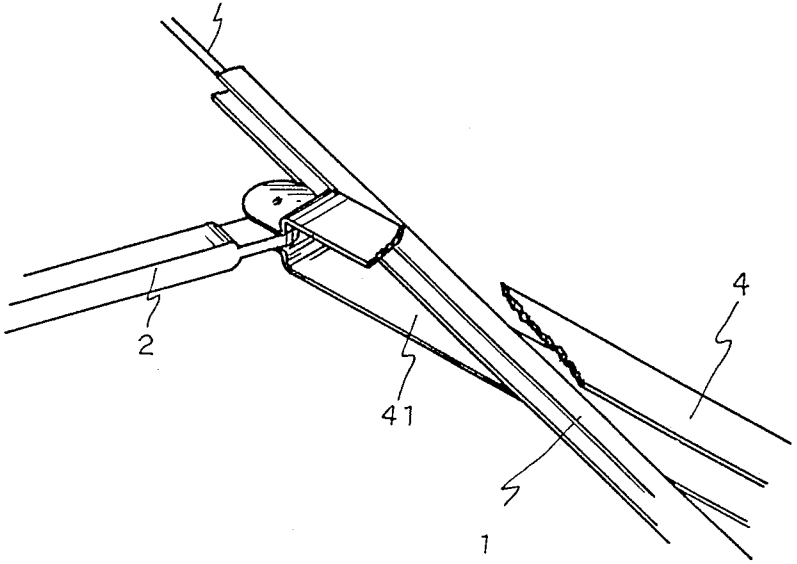
Figures 1, 2B:
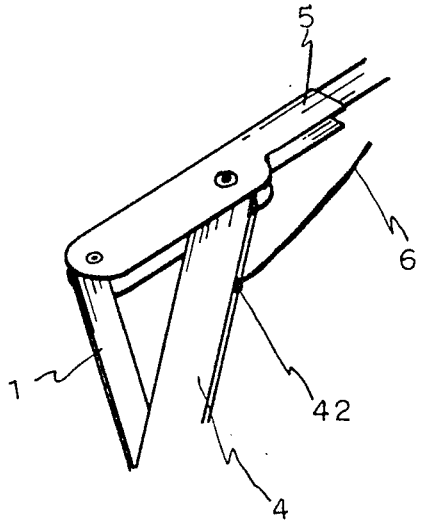
Figures 2, 2B:
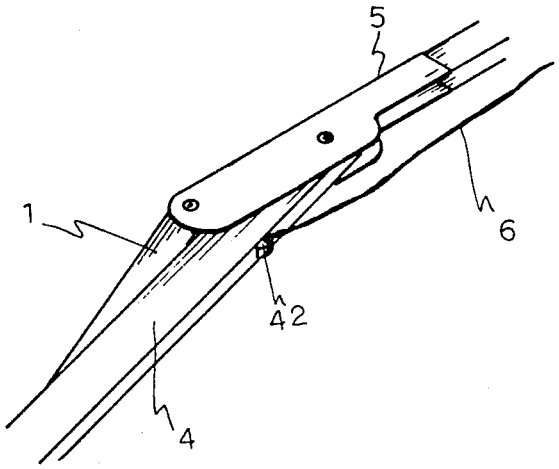

Referring to FIG. 2, the present invention comprises upper nest plate (10), lower nest plate (20), central shaft (30), first main rib (1), second main rib (2), auxiliary rib (3), linking rib (4), first support rib (5), flexible rib (6), and terminal rib (7). The said upper nest plate (10) is fixedly mounted on the top end of the central shaft (30) and the said lower nest plate (20) is attached to the central shaft (30) at the lower portion by slip joint. The front expansible rib (11) of the first main rib (1) and the front end of the auxiliary rib (3) are connected to the circumference of the upper nest plate (10) by pivotal joint. The rear end of the expansible rib (11) is expansibly set in the "U"-channel of the first main rib (1). The rear end of the auxiliary rib (3) is connected to the middle part of the second main rib (2) by pivotal joint. The front end of the second main rib (2) is mounted on the lower nest plate (20) by pivotal joint, and the rear end of the second main rib (2) is connected with the front end of the linking rib (4) by pivotal joint. The rear end of the linking rib (4) is mounted on the front part of the first support rib (5) by pivotal joint. The first main rib (1) comprises a circular surface at the rear end to connect with the front end of the first support rib (5) by pivotal joint. The front end of the flexible rib (6) is connected to the linking point (42) at the rear end of the linking rib (4) by hook joint, and the rear end is connected to the front end of the terminal rib (7) by pivotal joint. The front end of the first support rib (5) is arranged to provide a prolonged flange (51) for the rear part of the linking rib (4) to pivotally set therein. The rear end of the first support rib (5) is connect to the front end of the terminal rib (5) by pivotal joint. The first main rib (1) is arranged to penetrate through the front slot (41) of the linking rib (4) and to slide therealong, and the flexible rib (6) is arranged to wind round the middle portion of the first support rib (5), such that the first main rib (1), the linking rib (4), and the first support rib (5) form /\ ABC. When the umbrella is opened, AB and BC are arranged in a strainght line, through linking-up effect, the rear part of AC is arranged in the U-channel of the prolonged flange (51), and AB is set in the front part of AC to form a stable and strong umbrella rib structure. Because AC is almost equal to AB+BC, the torsional force is approximately zero. Therefore, the rib structure is well protected to provide high durability.

Figure 3A:
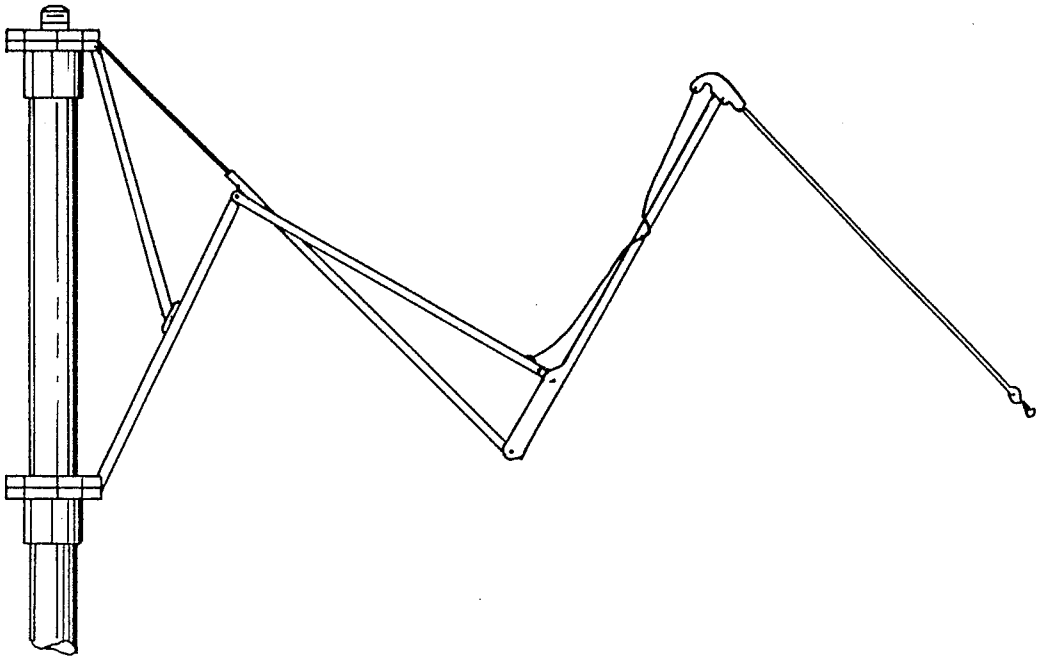
FIG. 3A is a schematic drawing illustrating one embodiment of the umbrella structure.
Figure 3B:
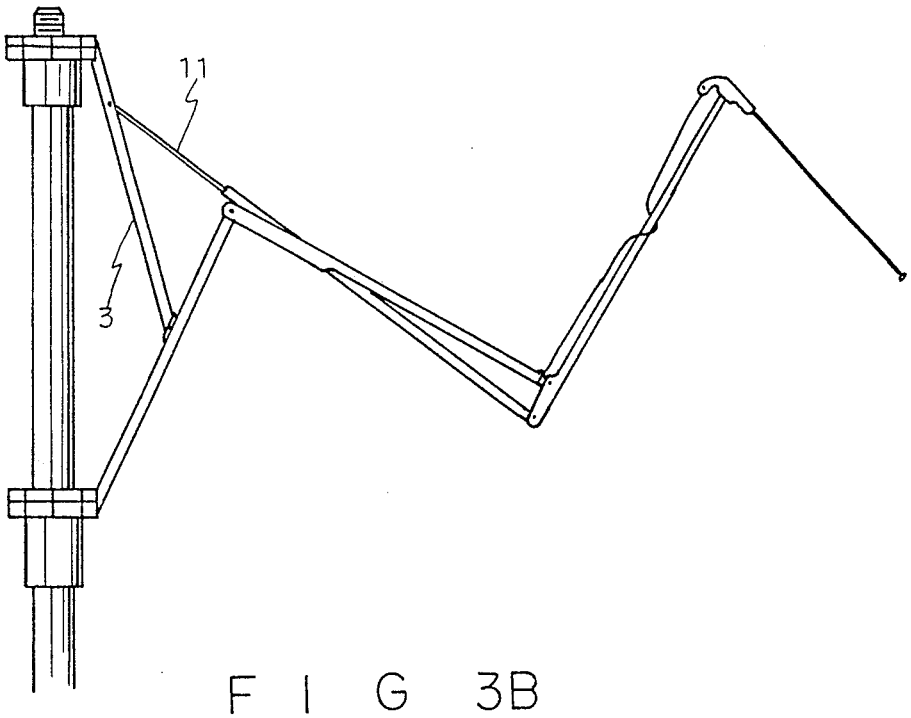
FIG. 3B is a schematic representation of the umbrella structure illustrating an alternate connection for the expansible rib of the embodiment shown in FIG. 3A.
Figure 3C:
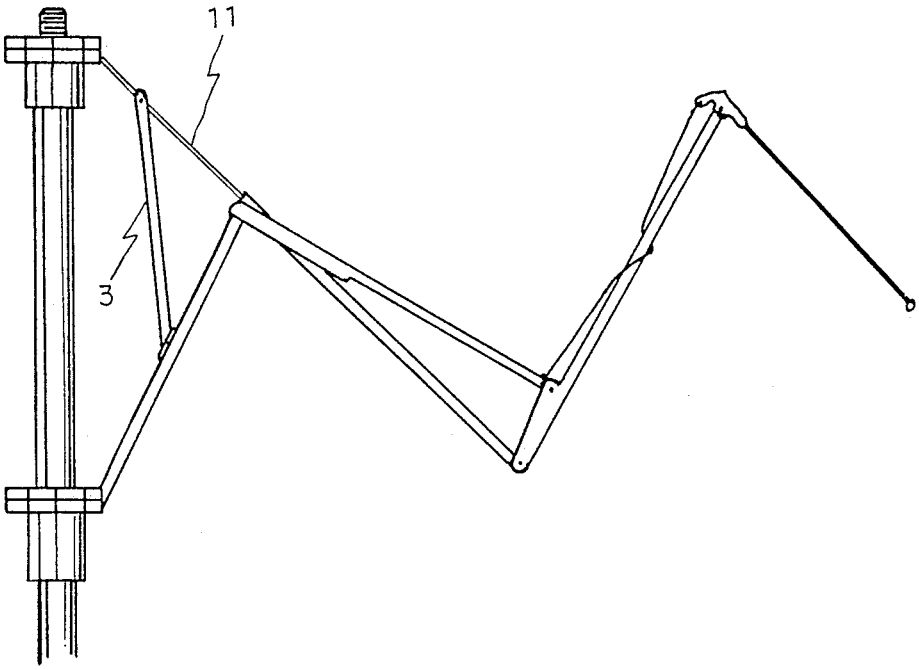
FIG. 3C is a schematic drawing of the umbrella structure illustrating an alternate connection for the auxiliary rib of the embodiment of FIG. 3A.
Figure 4A:
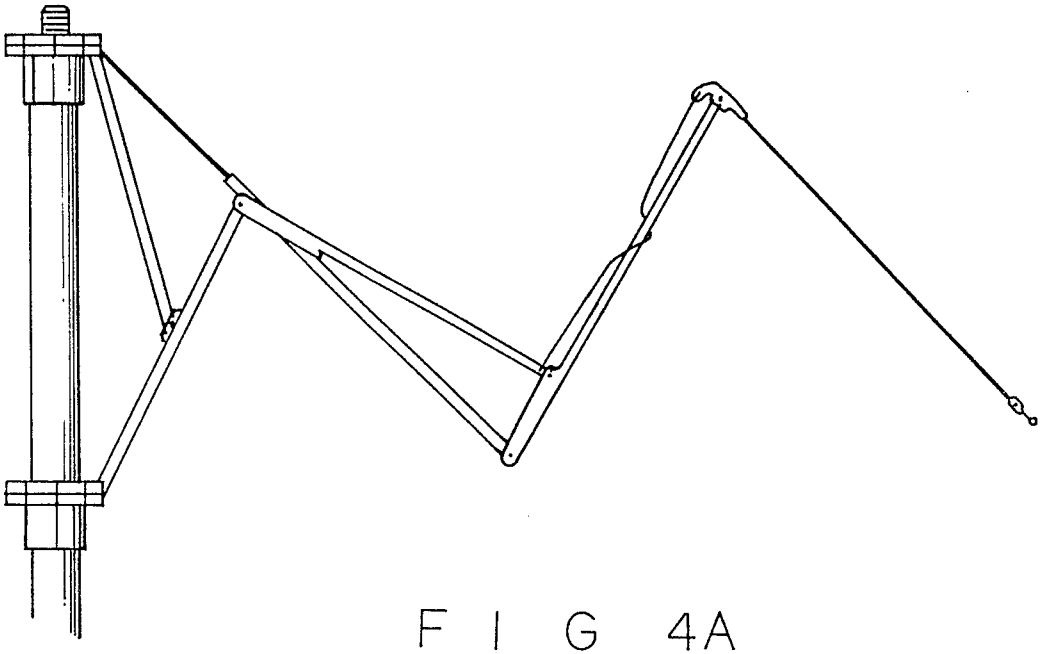
FIG. 4A is a schematic drawing of an alternate embodiment for the umbrella structure.
Figure 4B:
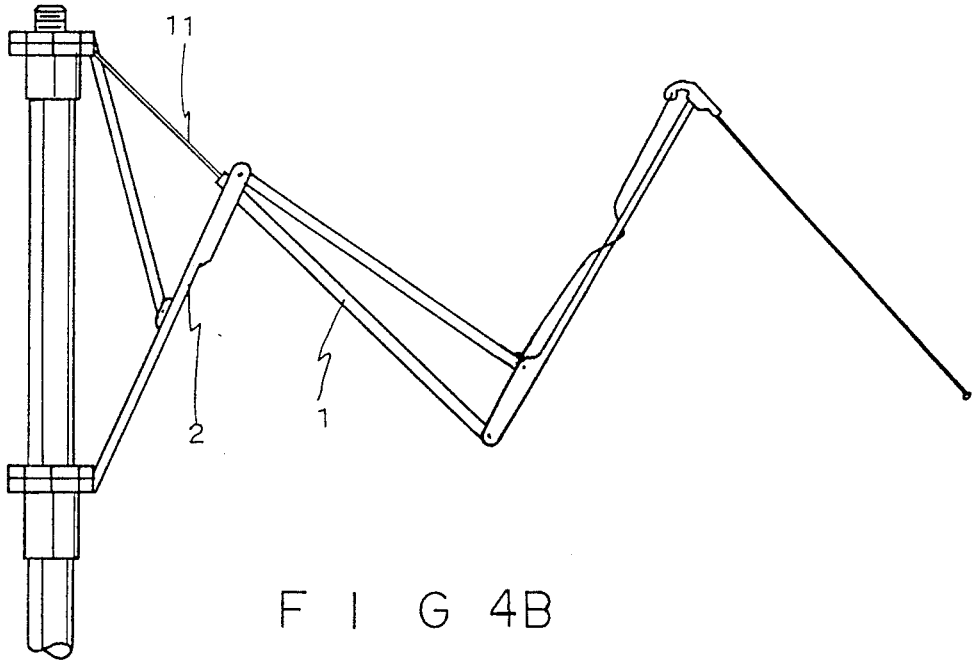
FIG. 4B is a schematic drawing illustrating an alternate connection for the main rib of the embodiment of FIG. 4A.
Figure 4C:
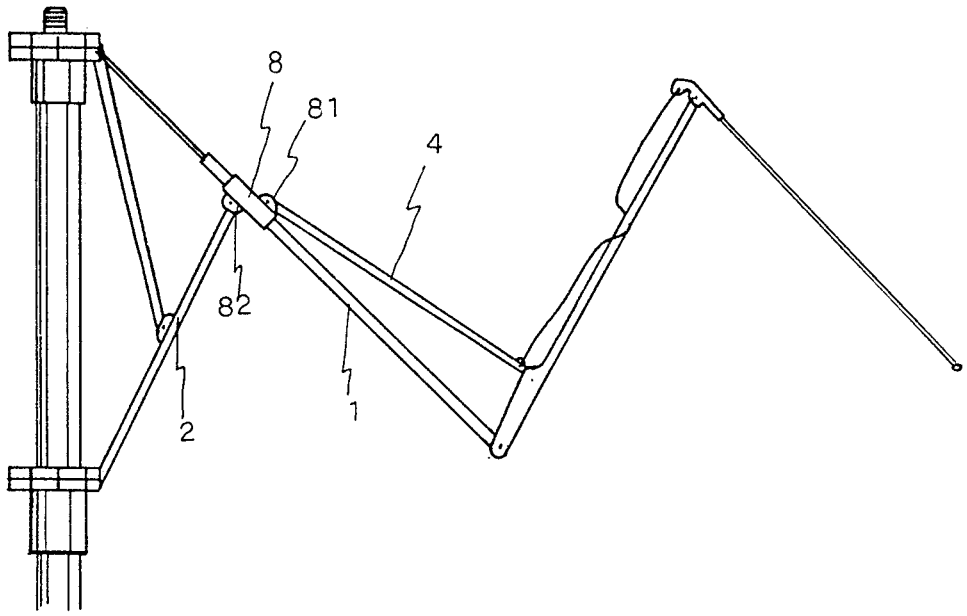
FIG. 4C is a schematic drawing illustrating alternate connections for the second main rib and linking rib of the embodiment of FIG. 4A.
Figure 5:
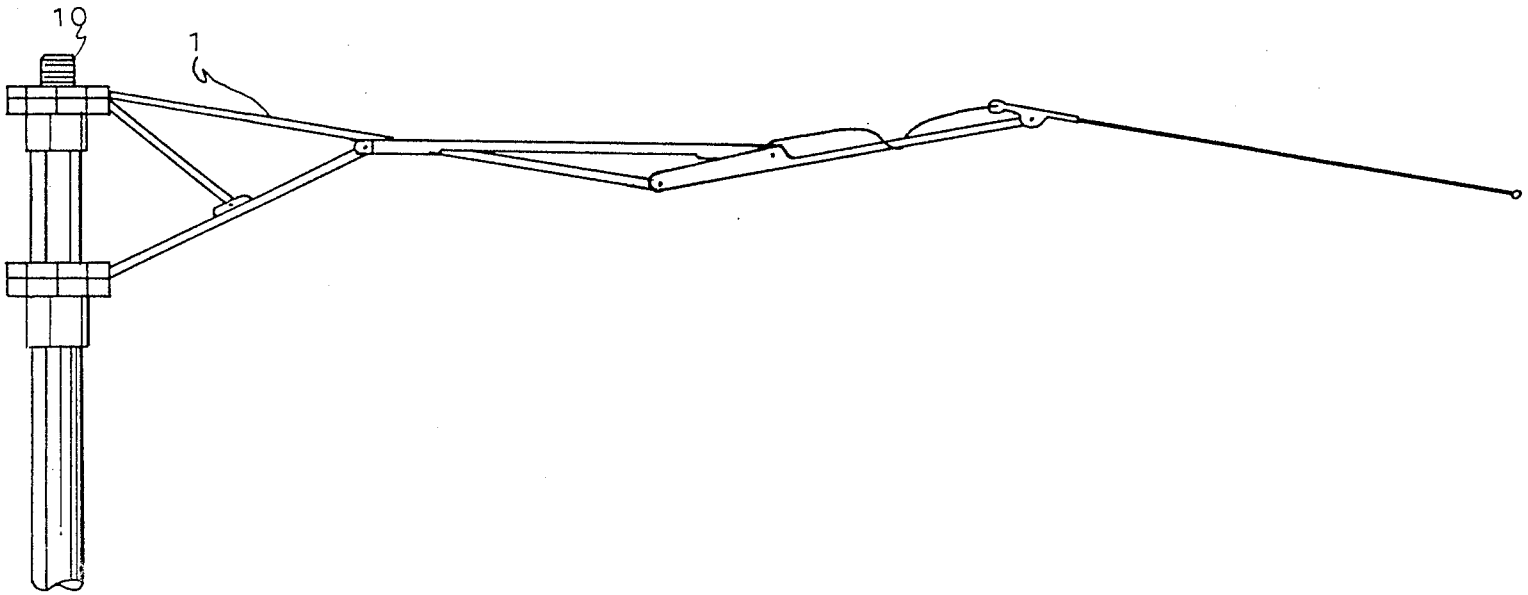
FIG. 5 is a schematic plain drawing of a tri-fold rib structure wherein the rib is not expansible.

Please refer to the embodiment of rib structure as illustrated in FIGS. 3 and 4. As shown in FIG. 3B, the front end of the expansible rib (11) is shifted to pivotally connect to the front end of the auxiliary rib (3). As shown in FIG. 3C, the front end of the auxiliary rib (3) is shifted to pivotally connect to the front end of the expansible rib (11). As shown in FIG. 4B, the first main rib (1) is shifted to penetrate through the front slot of the second main rib (2). As shown in FIG. 4C, the first main rib (1) is attached with a bushing (8) by slip joint, the second main rib (2) is pivotally connected to the contact point (82) of the bushing (8), and the front end of the linking rib (4) is pivotally connected to the contact point (81) of the bushing (8).

Referring to the structure of non-expansible tri-fold ribs, the front end of the first main rib (1) does not comprise an expansible rib (11) and is directly mounted on the upper nest plate (10) by pivotal joint.

Figure 6:
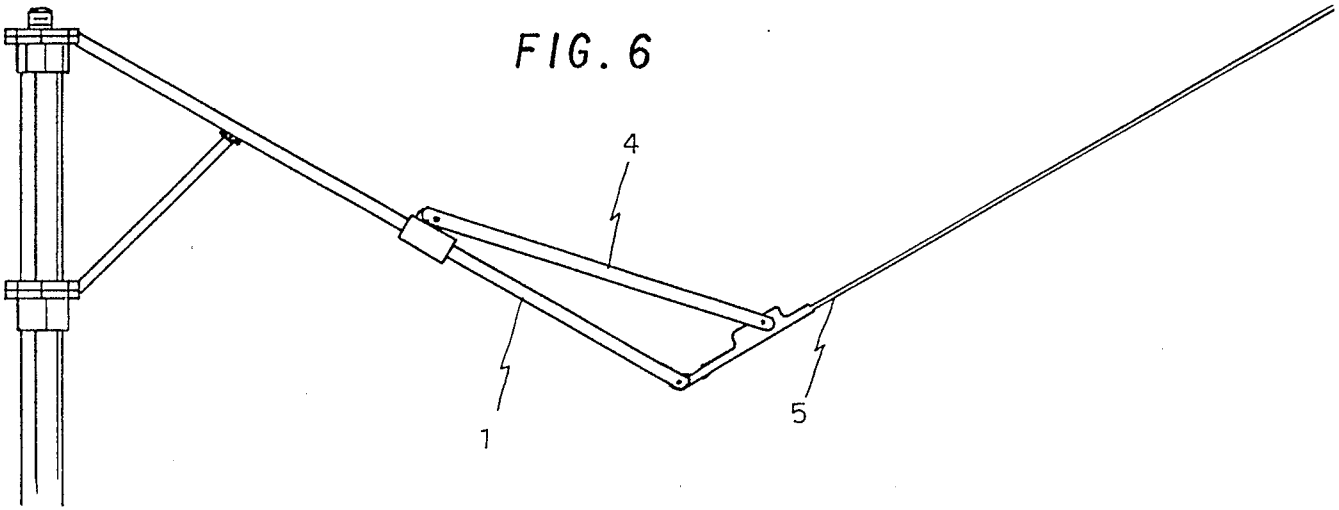
Figures 1, 6:
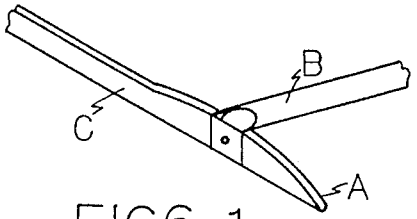

Referring to FIG. 6, it illustrates a triangular rib structure for use in a two-fold umbrella. The front end of the rib (5) does not comprises protruding portion A, and the rib (1) is directly connected to the rib (5) by pivotal joint to prevent umbrella cloth from jamming by the protruding portion A. The pivotal connection of the rib (1) and the rib (5) is set in the U-channel of the rib (4) when the umbrella is opened, such that the whole structure of the umbrella ribs provides better stability to stretch umbrella cloth.

Figure 7:
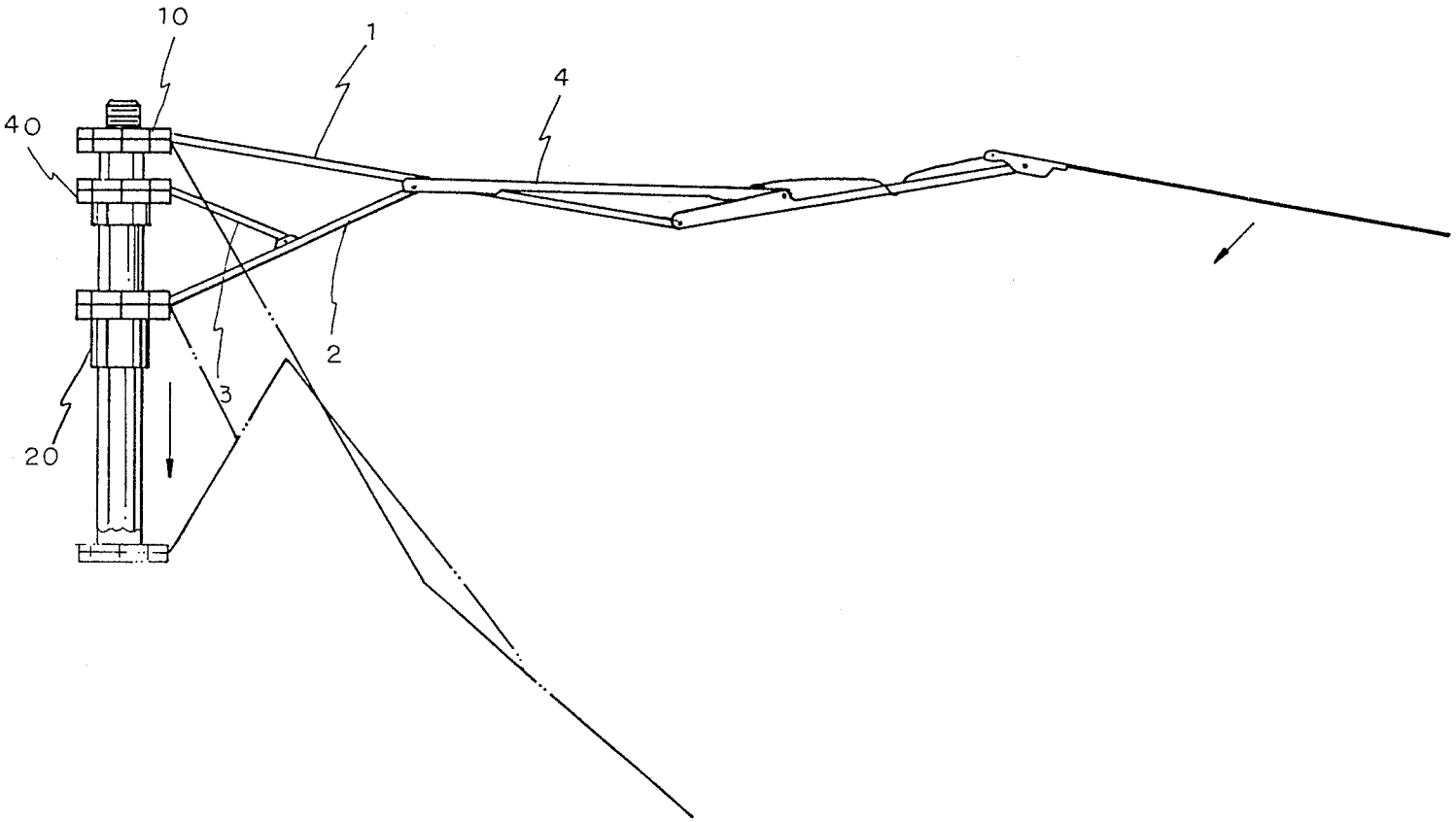
FIG. 7 is a schematic drawing of the present invention for use as a straight type umbrella, illustrating the position of the pivotal connection of the auxiliary rib.

Referring to FIG. 7, the umbrella is collapsed with the ribs kept in straight type. An additional intermediate nest plate (40) is amounted on the shaft arranged between the upper nest plate (10) and the lower nest plate (20) by means of slip joint. The front end of the auxiliary rib (3) is shifted to pivotally connect to the intermediate nest plate (30), and the rear end of the auxiliary rib (3) is still connected to the middle part of the second main rib (2). When the umbrella is collapsed, the auxiliary rib (3) is driven to slide by the intermediate nest plate (40). When the lower nest plate (20) moves downward, the intermediate nest plate (40) follows to move downward. When the second main rib (2) moves downward, the auxiliary rib (3) follows to move downward too. When the second main rib (2) is moving downward, it is not dragged by the auxiliary rib (3), he linking rib (4) will not be drawn inward to the first main rib, and the whole structure of the ribs will follow the second main rib (2) to move downward in a straight line to collapse. Therefore, the present foldable umbrella can also be used as a straight type and non-foldable umbrella.

Referring to FIG. 8, is illustrates unstable positioning of the lower nest plate in the prior art.

Referring to FIG. 9, with respect to the collapsible central shaft of the present invention. The collapsing mechanism of the central shaft includes a lower nest plate (20), a central shaft (30), and a stopper (311). The said central shaft (30) is comprised of four steps of shafts (31) (32) (33) (34) mounted one another by slip joint. The lower nest plate (20) is mounted on the central shaft (30) by slip joint. The stopper (333) is arranged at the lower portion of the shaft (31). The shaft (32) is arranged to provide a protruding and circular tail (321). Each of the shafts (31) (32) is arranged to provide two recessed channels (312) (313), (322) (323) respectively for the length of the shaft. The shaft (33) is arranged to provide single recessed channel (331) for the length of the shaft. And the shaft (34) is arranged to two recessed channels (341) (342) for partial length of the shaft. When the umbrella is opened, the lower nest plate (20) is moved to the top, the gap between the lower nest plate (20) and the shaft (30) is stopped by the circular protruding tail (321) to stabilize the lower nest plate such that the locating hole (201) will not break away from the stopper (311). When to collapse the umbrella, the shafts (31) (32) (33) (34) are arranged to set in one another by means of respective recessed channels to prevent from revolving, and the stopper is always aimed at the locating hole (201) and will not break away.

Figure 11A:
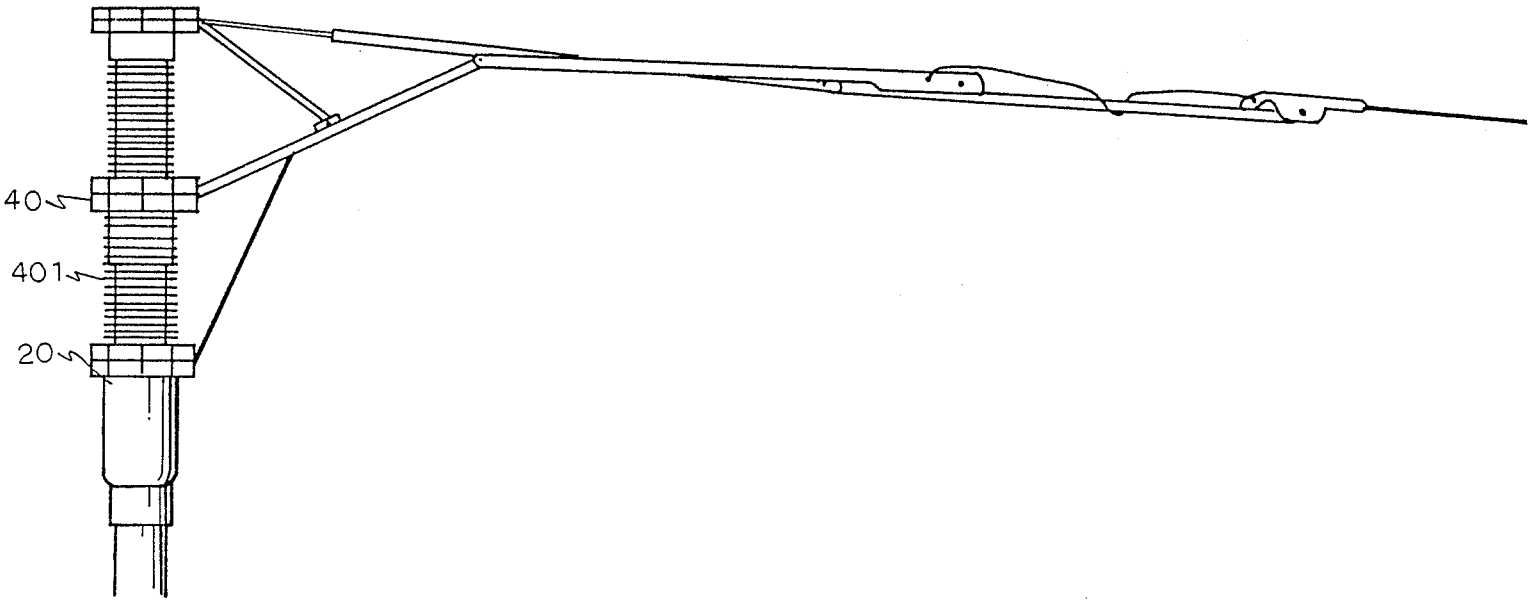
FIG. 11A is a schematic drawing of the umbrella structure in an automatic umbrella application.
Figures 1, 11B:
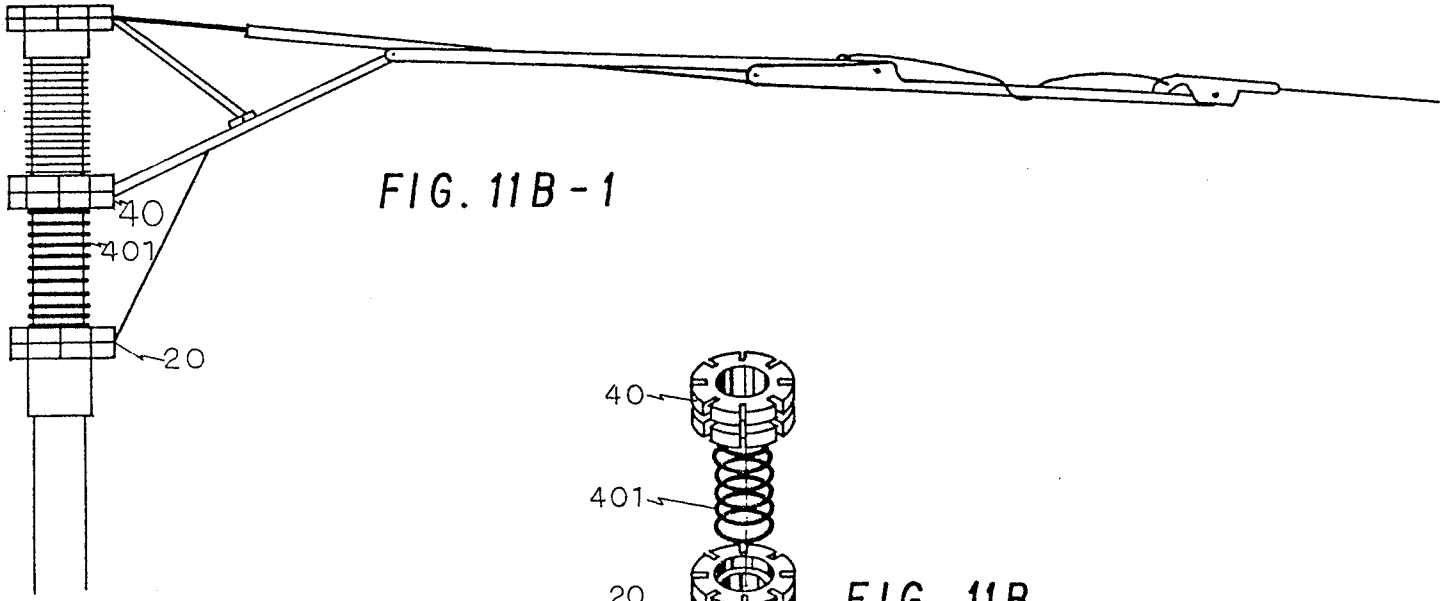
FIG. 11B is an exploded view of the nest plate structure in an automatic umbrella application.
Figure 11B:
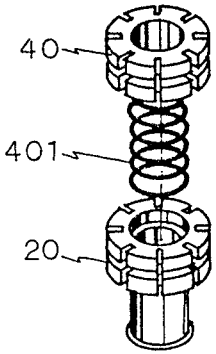

Referring to FIG. 11, with respect to the utilization of the present collapsible central shaft in an automatic umbrella, wherein the spring (401) and the intermediate nest plate (40) are molded in an integrated unit to minimize the diameter of the spring (401) for better performance.

Figures 12, 12A, 12B:
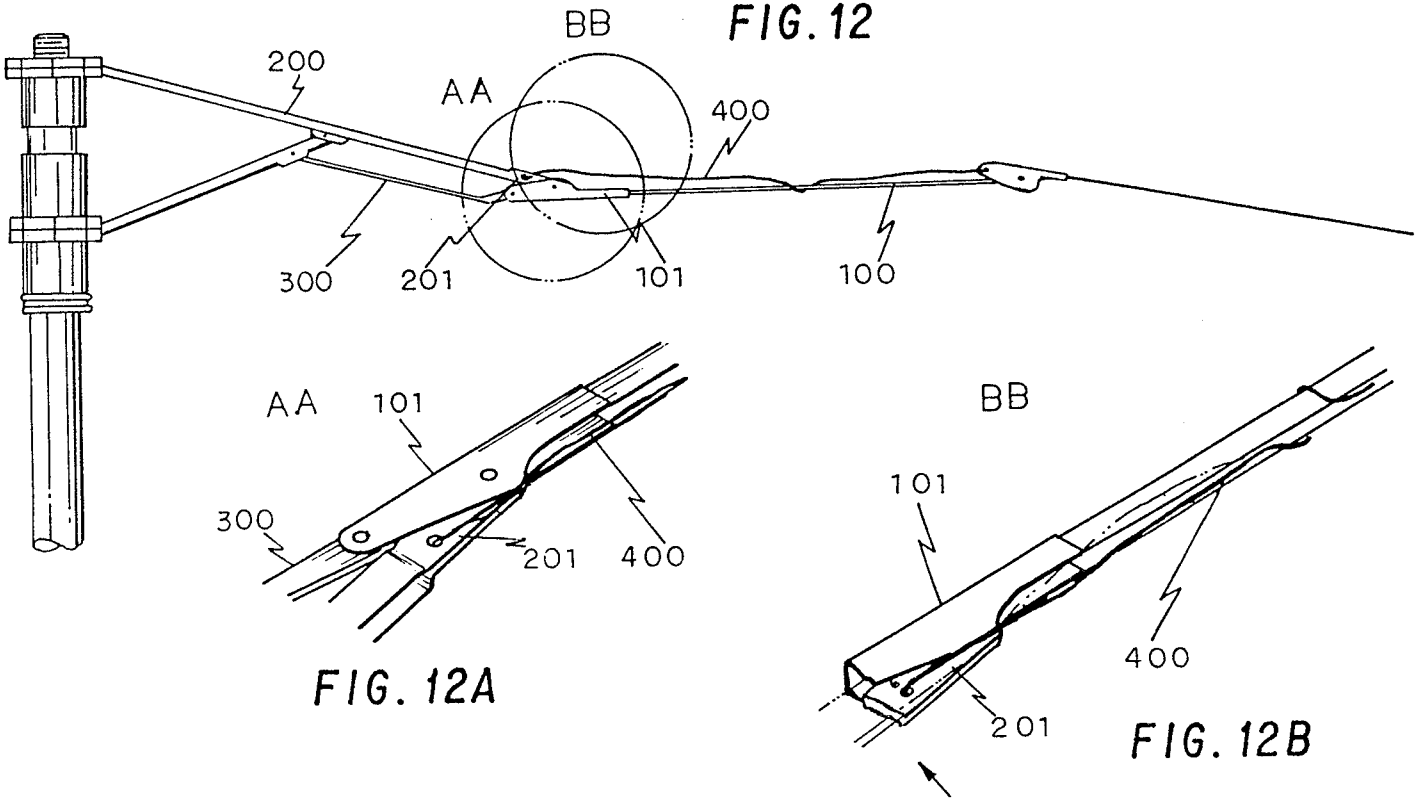
FIG. 12 is a schematic dawing illustrating another alternate embodiment of the umbrella rib structure.
FIG. 12A is an exploded perspective view of the pivotal plate joint shown in FIG. 12.
FIG. 12B is a partial perspective view illustrating the pivotal plate joint and flexible rib of the embodiment of FIG. 12.

Referring to FIG. 12 with respect to the utilization of the present invention in regular umbrella ribs. When the umbrella is opened, the flat portion (201) at the rear end of the rib (200) is set in the U-channel of the pivotal plate (101). The flexible rib (400) which is connected with the flat portion (201) by hook joint is to stop at the top of the U-channel of the pivotal plate (101) when the flat portion (201) is set in the U-channel, so as to provide a fulcrum to reinforce the stability of the rib structure.

In general, the present invention provides such a triangular umbrella rib structure having numerous features each of which tends to make the structure practical and utilitarian as well as inexpensive to manufacturer and durable and stable in use. This rib structure is applicable for use in straight type, double-fold type, tri-fold type, and four-fold type umbrellas, to let the umbrella provide best performance.

I claim:

1. Expansible type triangular umbrella ribs and the related collapsing mechanism, comprised of an upper nest plate, a lower nest plate, a central shaft, a first main rib, a second main rib, an auxiliary rib, a linking rib, a first support rib, a flexible rib, and a terminal rib, said upper nest plate being fixedly mounted at a top section of the central shaft, said lower nest plate being mounted to the central shaft by a slip joint for sliding therealong, a front end of the first main rib and the second main rib connected to the upper nest plate and the lower nest plate respectively, a front end of the auxiliary rib is connected to the upper nest plate and a rear end of the auxiliary rib is connected to a middle portion of the second main rib, said first main rib comprising an expansible rib set in a U-channel, a rear end of the second main rib is pivotally connected to a front end of the linking rib, the rear end of the first main rib being arranged to penetrate through the front portion of the linking rib for sliding displacement therealong; by means of respective pivotal connection, the first main rib, the linking rib and the first support rib forming a triangular linked umbrella rib structure, the first support rib being arranged to provide a prolonged flange at a front U-channel for receiving the connection at the rear portion of the linking rib to reinforce the pivotal connection; the first main rib, the linking rib and the first support rib being arranged in a straight line at the time the umbrella is opened, in order to minimize the interval and the torsional force, to reinforce the rib structure, and the extend the durability of the umbrella, the front end of said flexible rib is connected to the rear portion of the linking rib by hook joint, the rear end of the flexible rib being connected with the front end of the terminal rib by a pivotal joint, the middle portion of the flexible rib winding around the central part of the first support rib by means of flexible winding around the first support rib, the flexible rib being slideable therealong when the umbrella is opened or collapsed.

2. Expansible type triangular umbrella ribs and the related collapsing mechanism according to claim 1, wherein the front end of the first main rib is directly connected to the upper nest plate by a pivotal joint for use as (1) a tri-fold umbrella when the first main rib does not comprise an expansible rib thereinside; and (2) a four fold umbrella when the first main rib is arranged to provide an expansible rib thereinside, the front end of the expansible rib being connected to the upper nest plate by the pivotal joint, and the rear end of the expansible rib being set in the front U-channel of the first main rib.

3. Expansible type triangular umbrella ribs and the related collapsing mechanism according to claim 1, wherein the structure is applicable for use as an automatic umbrella.

4. Expansible type triangular umbrella ribs and the related collapsing mechanism according to claim 1, wherein the central shaft is comprised of four steps to set in one another, the first step and the second step of the shaft comprising two symmetrical recessed channel for the length of respective step, the third step comprising single recessed channel. The fourth step of the shaft comprising two recessed channel for partial length of the step; by means of the guiding of the respective recessed channels, the steps of the shaft being arranged to collapse in proper order to prohibit revolving of the shaft and to keep the stopper be aimed at right direction for error-free fixation.

* * * * *